US009992575B2

(12) United States Patent
Wang et al.

(10) Patent No.: US 9,992,575 B2
(45) Date of Patent: Jun. 5, 2018

(54) PORTABLE SPEAKER AND ASSEMBLY THEREOF

(71) Applicant: FOXCONN INTERCONNECT TECHNOLOGY LIMITED, Grand Cayman (KY)

(72) Inventors: Xiao-Qin Wang, New Taipei (TW); Chin-Chu Cheng, New Taipei (TW); Hui-Cheng Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/257,011

(22) Filed: Sep. 6, 2016

(65) Prior Publication Data

US 2018/0035210 A1 Feb. 1, 2018

(30) Foreign Application Priority Data

Jul. 26, 2016 (CN) ..... 2016 1 0589316

(51) Int. Cl.
*H04R 1/02* (2006.01)
*H04R 5/02* (2006.01)
*H04R 31/00* (2006.01)

(52) U.S. Cl.
CPC ..... *H04R 5/02* (2013.01); *H04R 31/006* (2013.01); *H04R 1/02* (2013.01)

(58) Field of Classification Search
CPC ..... H04R 5/02; H04R 1/26
USPC ..... 381/334, 336, 84
See application file for complete search history.

(56) References Cited

U.S. PATENT DOCUMENTS 5,253,301 A * 10/1993 Sakamoto ..... H04R 1/2826 181/145
D487,075 S 2/2004 Dayan
D518,029 S 3/2006 Tsang
D598,899 S 8/2009 Tkachuk
7,782,012 B2 * 8/2010 Jo ..... H02J 7/0044 320/115
7,804,966 B2 * 9/2010 Adams ..... H04R 1/02 381/120
D644,206 S 8/2011 Ponnert
(Continued)

FOREIGN PATENT DOCUMENTS

JP 2009-253591 10/2009
TW M326302 1/2008
(Continued)

OTHER PUBLICATIONS

"Eggy portable mini speakers come from my fantasy chicken" by Evan Ackerman on Dec. 22, 2009.*

*Primary Examiner* — Disler Paul
(74) *Attorney, Agent, or Firm* — Wei Te Chung; Ming Chieh Chang

(57) ABSTRACT

A speaker assembly comprises two separate and symmetrical speakers combining together in a reversed manner. Each speaker includes a base surface for seating said speaker and a sound emission surface provided at one front side thereof for an emission of sound derived from the speaker. Wherein each speaker defines a mating surface which the sound emission surface is located at and said two speakers can be secured to each other snugly into an integral unit by jointing two mating surfaces thereof via a magnetic force.

17 Claims, 7 Drawing Sheets

(56) References Cited

U.S. PATENT DOCUMENTS

| | | | | |
|---|---|---|---|---|
| D670,271 | S | 11/2012 | Tzeng | |
| 8,989,420 | B1 * | 3/2015 | Hamer | H04R 1/02 381/122 |
| 2006/0133625 | A1 * | 6/2006 | Adams | H04R 1/02 381/120 |
| 2007/0170182 | A1 * | 7/2007 | Xiao | F16M 11/06 220/4.24 |
| 2010/0002898 | A1 * | 1/2010 | Murray | H04R 5/02 381/334 |
| 2015/0036858 | A1 * | 2/2015 | Aboabdo | H04R 1/02 381/334 |
| 2015/0201255 | A1 * | 7/2015 | Porter | H04R 1/00 381/334 |

FOREIGN PATENT DOCUMENTS

| | | | |
|---|---|---|---|
| WO | 2014/161475 | A1 | 9/2014 |
| WO | 2015/067007 | | 5/2015 |

* cited by examiner

PORTABLE SPEAKER AND ASSEMBLY THEREOF

BACKGROUND OF THE INVENTION

1. Field of the Invention

The present invention relates to a speaker assembly, and particularly to a portable speaker assembly.

2. Description of Related Art

The speaker is popular as an acoustic system and in order to improve the naturalness of sound, a speaker assembly with a left-channel audio and a right-channel audio is provided jointly. However, there is a problem that two said audios are not space-saving and not convenient for carrying, what is worse that some cables or wires have to be applied between two said audios for a data transmission, which results in foreseeable troubles and increases risks of damage.

Hence, a speaker including an improved structure is necessary.

SUMMARY OF THE INVENTION

Accordingly, an object of the present invention is to provide a speaker assembly and a speaker overcoming the aforementioned shortcomings.

To achieve the above object, a speaker assembly is disclosed, comprising two separate and symmetrical speakers combining together in a reversed manner, each speaker including a base for seating said speaker and a sound emission surface provided at one front side thereof for an emission of sound derived from the speaker; wherein each speaker defines a mating surface which the sound emission surface is located at and said two speakers can be secured to each other snugly into an integral unit by jointing two mating surfaces thereof via a magnetic force.

To achieve the above object, a speaker is disclosed, comprising a sound emission surface for emitting sound derived from the speaker, wherein said speaker is semi-cylinder having a round bottom surface, a semi-cylindrical surface and a mating surface shrouding the semi-cylindrical surface, so that two said speakers can combine into a complete cylinder in shape when one of them is turned over and mates to the other at two said mating surfaces, wherein the sound emission surface is located at the mating surface.

Other objects, advantages and novel features of the invention will become more apparent from the following detailed description when taken in conjunction with the accompanying drawings.

DETAILED DESCRIPTION OF THE PREFERRED EMBODIMENT

Figure 1:
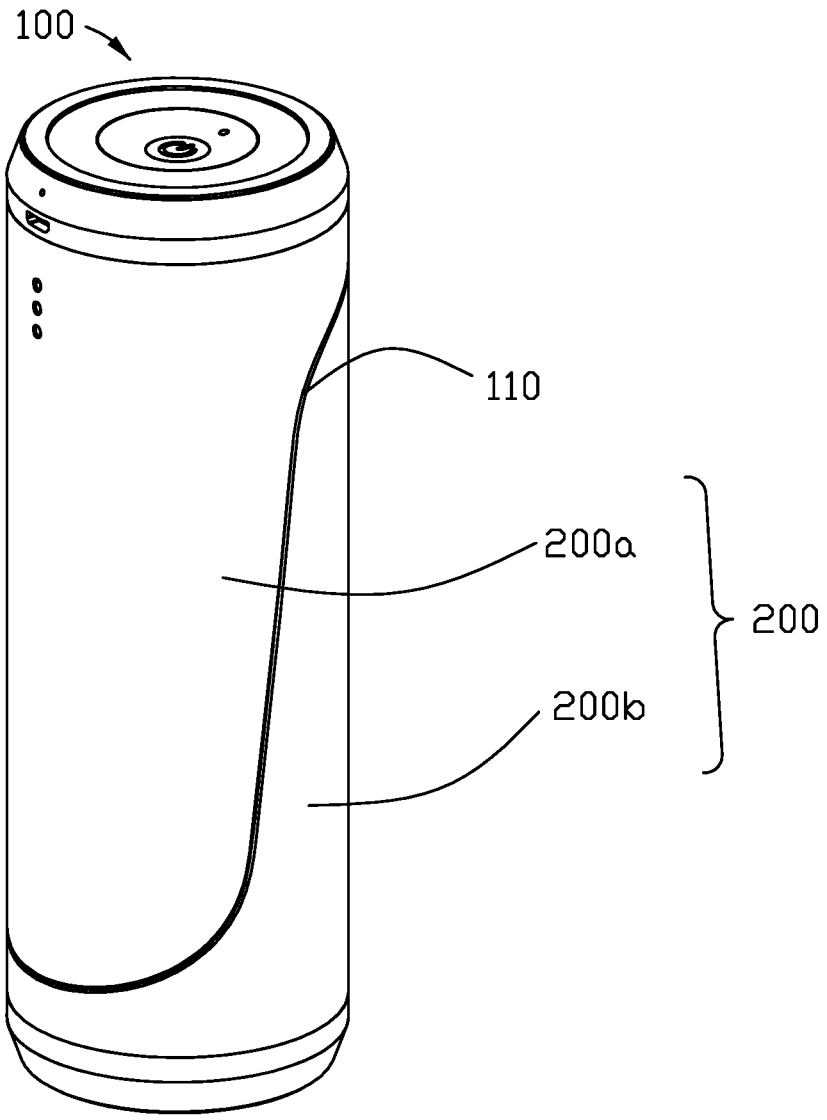
FIG. 1 is a perspective view of a speaker assembly in an assembled state according to the preferred embodiment of the invention.
Figure 2:
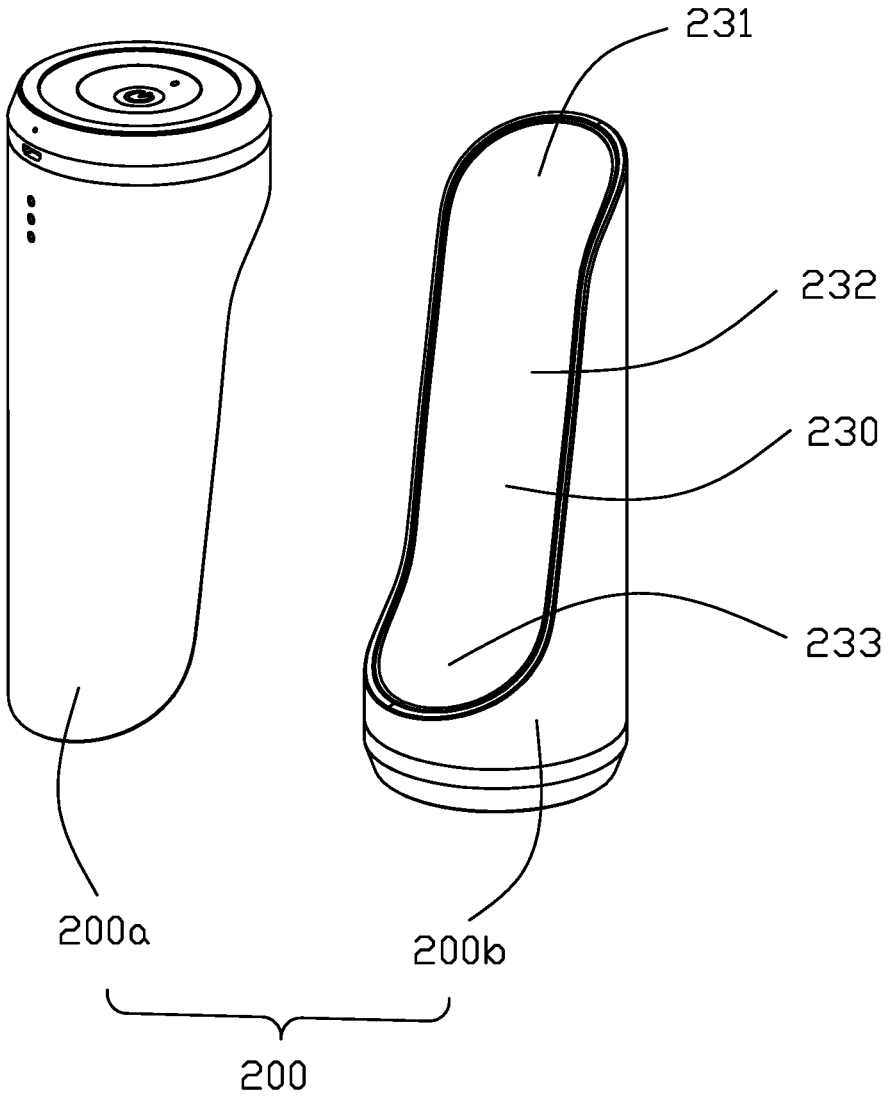
FIG. 2 is a perspective view of the speaker assembly shown in FIG. 1, in a disassembled state.
Figure 7:
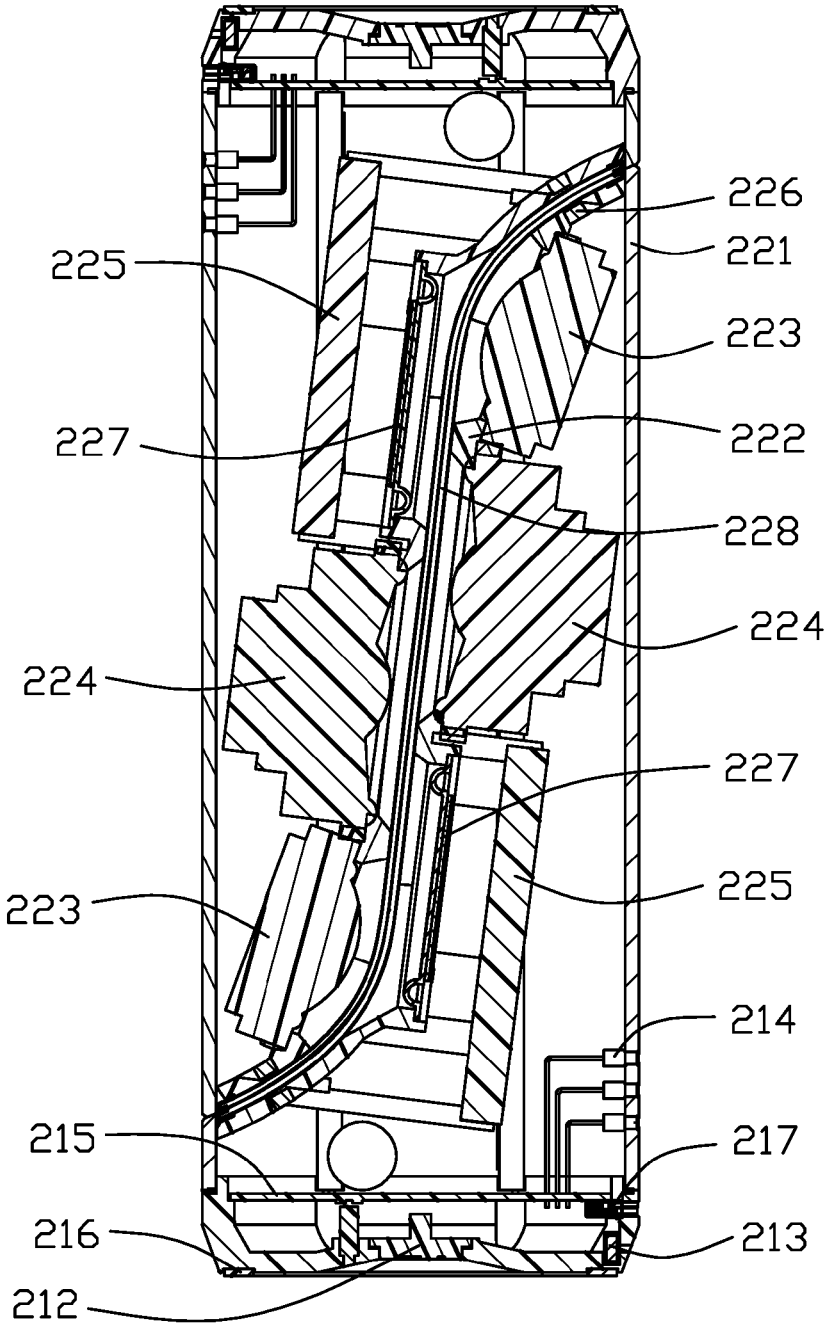
FIG. 7 is a cross-section of the speaker assembly of FIG. 1.

Reference will now be made in detail to the preferred embodiment of the present invention. Referring to FIGS. 1-2 and 7, the present invention provides a portable speaker assembly 100 consisted of two exactly same and independent speakers 200 in shape and construction which are automatically distributed as a left-channel audio 200*a* and a right-channel audio 200*b* when the speaker assembly 100 is working. The speaker assembly 100 presents a completely cylindrical shape in a combined state that the left-channel audio 200*a* and the right-channel audio 200*b* are secured to each other forming an integral unit via a magnetic force at their mating surfaces 230. Each speaker 200 includes a sound emission surface disposed on the mating surface 230, for emitting sound derived from the speaker 200. Notably, the sound emission surface is the same as the mating surface 230 in this embodiment, and the speaker 200 emits sound forwardly from the mating surface 230 in a front-to-back direction.

The left-channel audio 200*a* and the right-channel audio 200*b* both are of semi-cylindrical shape and generally the same as each other. Said complete cylinder is formed when turning over one of the left-channel audio 200*a* and the right-channel audio 200*b* with respect to the other to make two mating surfaces 230 adjacent to and finally fitly lean on each other. The mating surface 230 cuts in and out of the complete cylindrical surface of a complete cylinder in a smooth way, which forms a bended loop-shaped track 110 on said cylindrical surface, so that each of the left-channel audio 200*a* and the right-channel audio 200*b* is a semi-cylinder in shape and includes a round bottom surface and a semi-cylindrical surface extending upwardly therefrom in a vertical direction perpendicular to the front-to-back direction and shrouded by said mating surface 230. The complete cylinder defines an axial section (not shown) which the mating surface 230 and the speaker 200 are left-right symmetric with respect to in a traverse direction perpendicular to both the front-to-back direction and the vertical direction, and the mating surface 230 has an S-shaped frontal projection on said axial section which extends obliquely in the vertical direction and the front-to-back direction.

Figure 3:
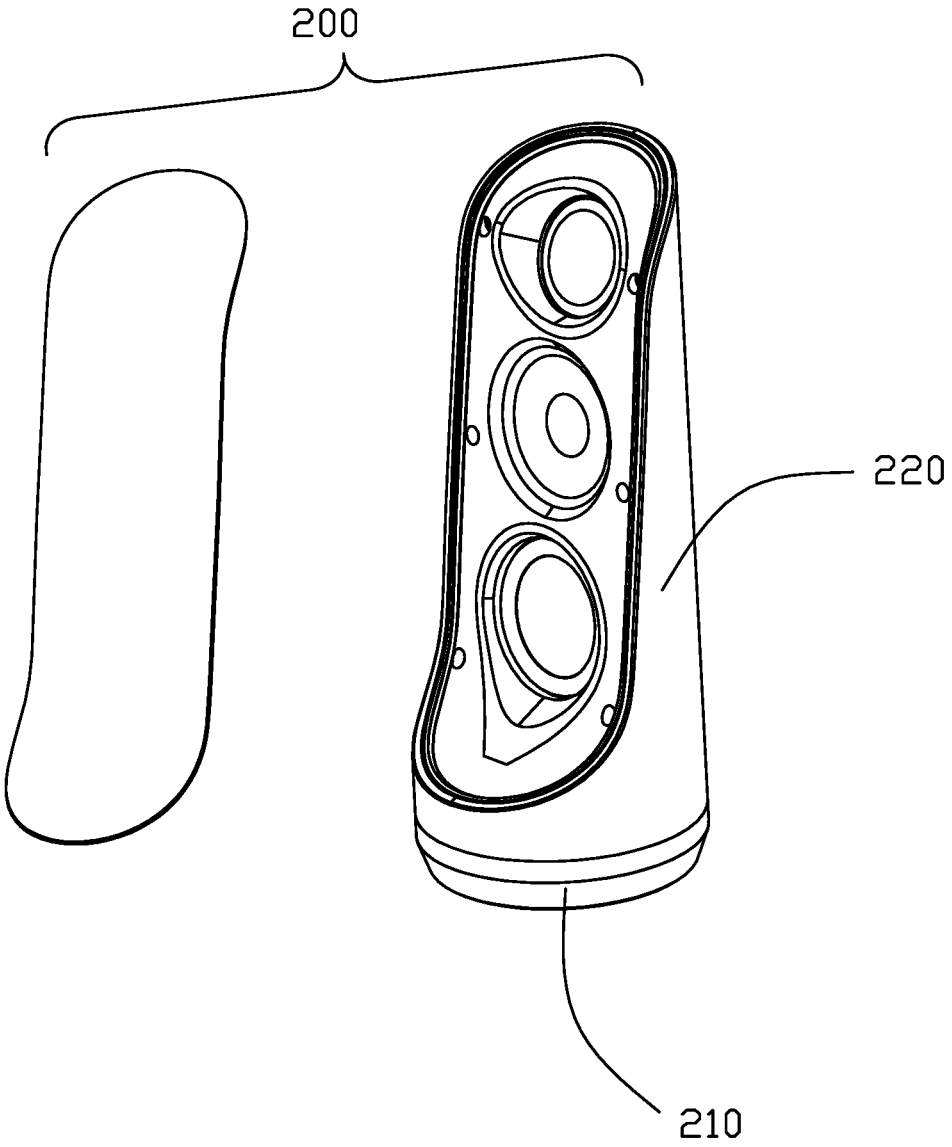
FIG. 3 is an exploded view of a speaker of the speaker assembly shown in FIG. 1, wherein a net is disassembled from the speaker.

Referring to FIGS. 2-3, the speaker 200 is approximately tower-shaped and gradually expands from up to down which is conducive to sitting stably. The mating surface 230 is S-shaped including an up-down oblique second/middle mating surface 232 and a first/top mating surface 231 curvedly extending backwardly from the top side thereof and a third/bottom mating surface 233 curvedly extending forwardly from the bottom side thereof. Notably, the first mating surface 231 and the third mating surface 233 are symmetrical/complementary to each other. When mating two speaker 200 together, the first mating surface 231 of one speaker 200 is corresponding to the third mating surface 233 of the other.

Figure 4:
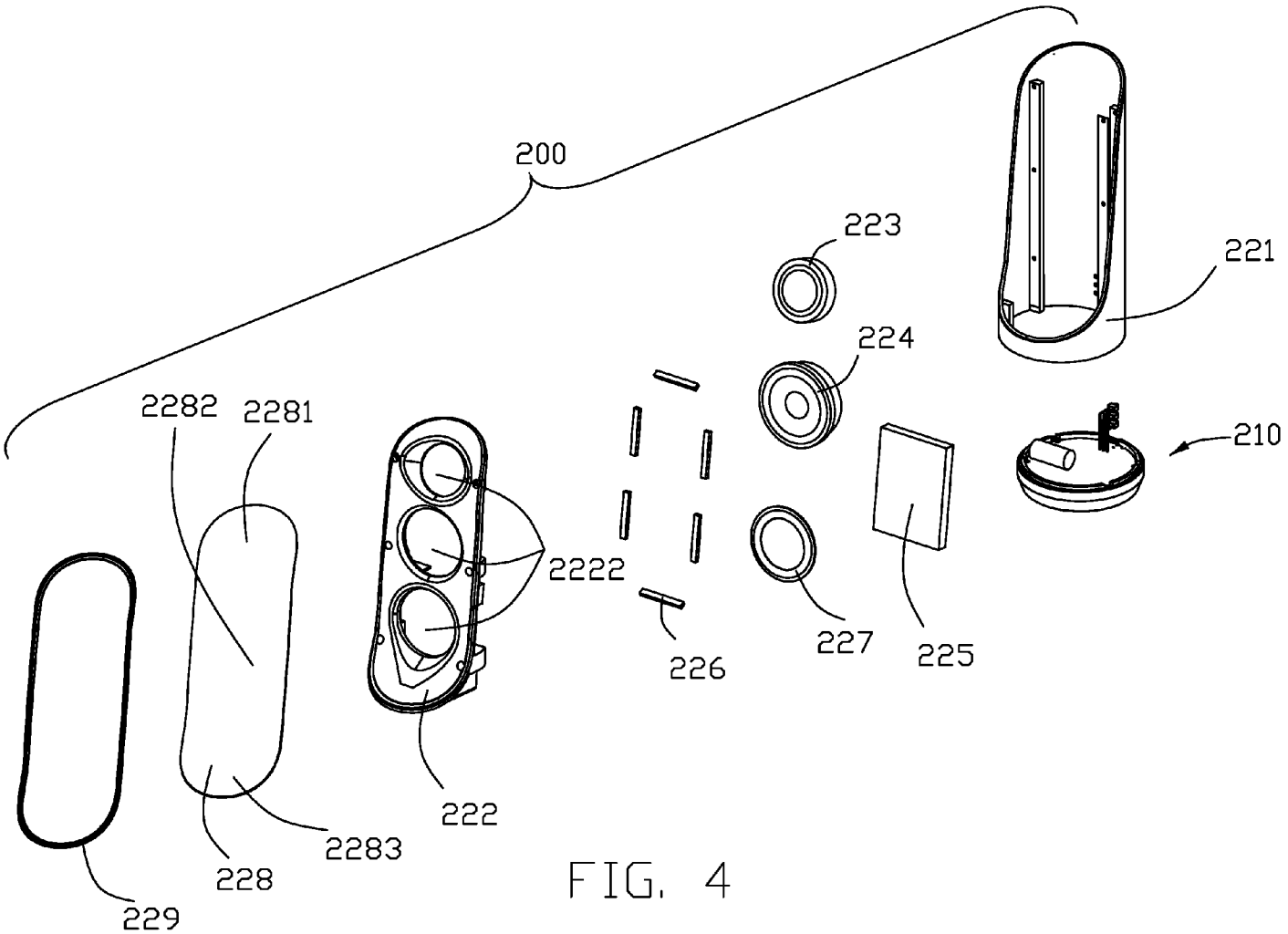
FIG. 4 is a further exploded view of the speaker shown in FIG. 3, wherein a base is disassembled from the speaker.
Figure 5:
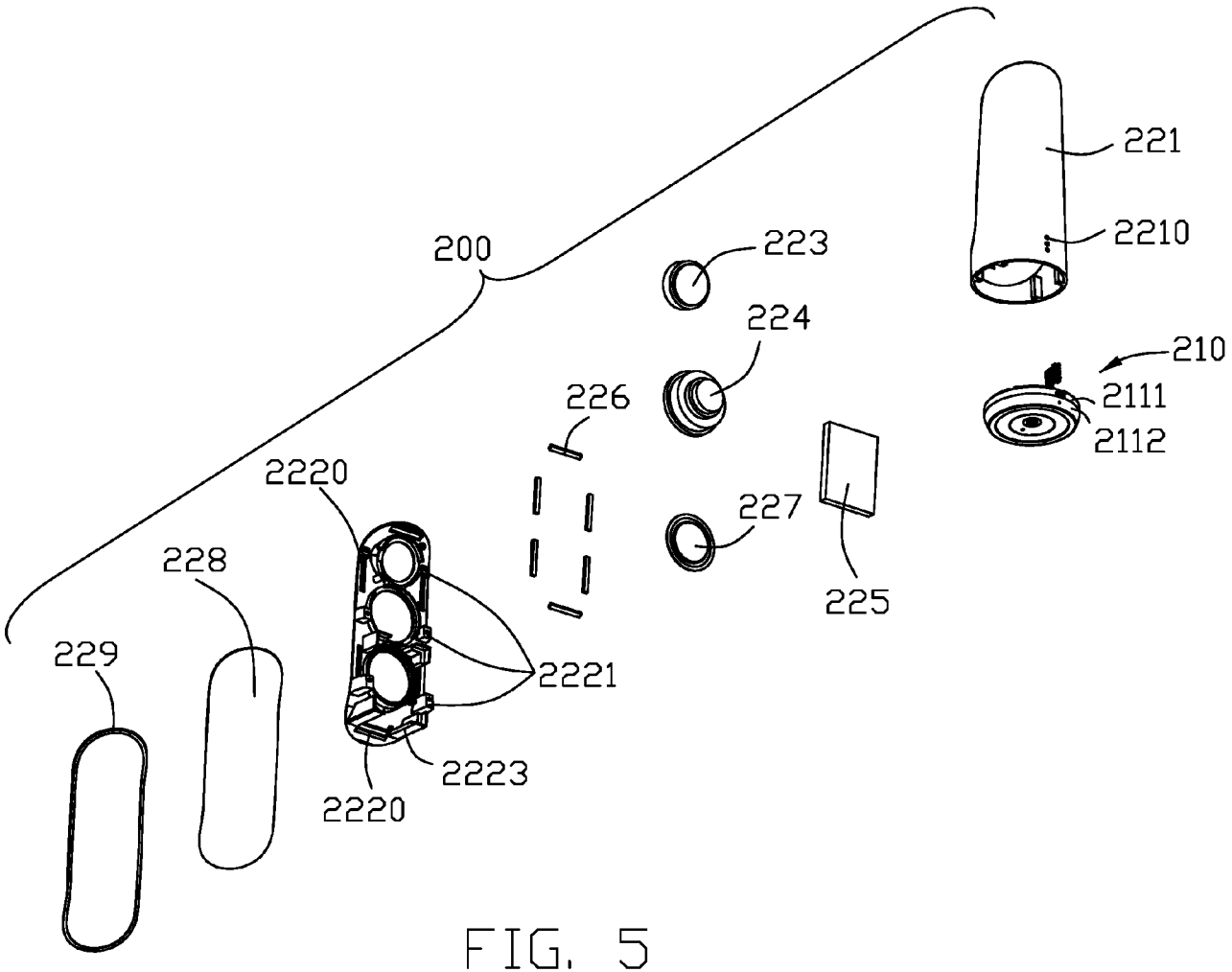
FIG. 5 is another exploded view of the speaker shown in FIG. 4.

Further referring to FIGS. 3-5, the speaker 200 includes a base 210 for seating the speaker 200 and a main body 220 assembled to the base 210 downwardly. The mating surface 230 is disposed on the main body 220 while the base 210 is disposed below the mating surface 230.

The main body 220 includes a tubby metallic rear cover 221 and an insulative front cover 222 assembled backwardly thereto, which forms a receiving cavity to receive a variety of parts such as a tweeter 223, a woofer 224, a passive radiator 227, a battery 225 and so on. The passive radiator 227 includes an insulative piece and a metallic piece which can increase the low frequency response of an audio system. The rear cover 221 defines three through holes 2210 traversing the back thereof and aligned to each other vertically so as to respectively correspond to three LEDs (light-emitting diode) 214 for instructing the charging state toward exterior during charging the speaker 200. The front cover 222 forms six blocks 2221 extending backwardly from the rear surface thereof, each of which defines a locking hole for an insertion of a screw so as to secure the front cover 222 to the rear cover 221. The speaker 200 also includes a plurality of magnets 226 retained in the corresponding recessions depressing the rear surface of the front cover 222 and the magnets 226 are evenly distributed along the side edge of the front cover 222 to form a toroidal magnetic field around the mating surface 230 for an automatically accurate positioning between two said mating surfaces 230. Wherein the magnets 226 respectively disposed in the two speakers 200 present opposite poles to each other for an attraction. In this embodiment, there are six magnets and six corresponding recessions, including opposite two in the vertical direction and opposite four in the traverse direction. Further, the front cover 222 defines three circle holes 2222 going therethrough in the front-to-back direction to respectively receiving the tweeter 223, the woofer 224 and the passive radiator 227 in series from up to down. Wherein the circle hole corresponding to the tweeter 223 is located at a corner between the first mating surface 231 and the second mating surface 232, and the circle hole corresponding to the woofer 224 is completely located at the second mating surface 232 while the circle hole corresponding to the passive radiator 227 is mainly located at the second mating surface 232 and partially located at the third mating surface 233. Each of the circle holes 2222 is of a proper depth for a good retention of the tweeter 223, woofer 224 and passive radiator 227. It is certain that said tweeter 223, woofer 224 and passive radiator 227 can be further fixed to the front cover 222 by means of stickup or screw locking. Said three circle holes 2222 are encircled by said six recessions 2220 and magnets 226, and said tweeter 223, woofer 224 and passive radiator 227 do not protrude out of the front surface of the front cover 222. The front cover 222 further forms four tubers 2223 protruding from the rear surface thereof and extending backwardly out of the rear end of the passive radiator 227 to construct a battery holder with a receiving space for receiving the battery 225 latched by the tubers 2223 at four corners thereof.

The speaker 200 includes a metallic net 228 stuck onto the front cover 222 backwardly and a rubber ring 229 shrouding the side edge of the net 228 and abutting against the inner surface of the rear cover 221. It should be noted that the front surface of the net 228 forms the sound emission surface as well as the mating surface 230 in this embodiment. When two speakers 200 are mated to each other, two rubber rings 229 of the left-channel audio 200*a* and the right-channel audio 200*b* contact to each other for a buffer action. In this embodiment, the net 228 and the rubber ring 229 are S-shaped which matches up with the shape of the mating surface 230. The net 228 includes a first piece 2281 corresponding to the first mating surface 231, a second piece 2282 corresponding to the second mating surface 232 and a third piece 2283 corresponding to the third mating surface 233. The shape of the mating surface 230 is conducive to expanding the sound emission surface and the assembling space for placing the tweeter 223, woofer 224, passive radiator 227 and battery 225, which is useful for miniaturization of the speaker 200 partly.

Figure 6:
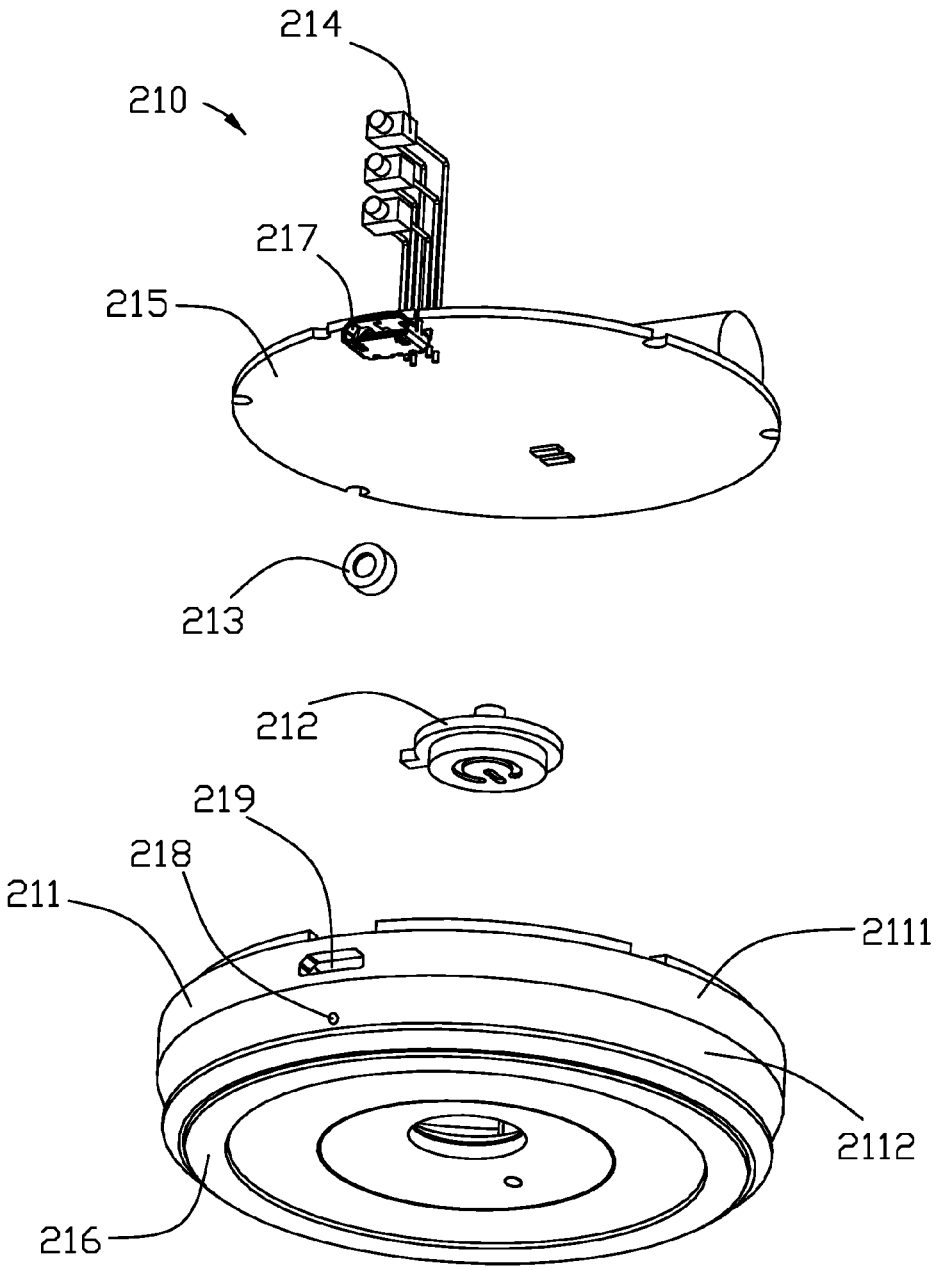
FIG. 6 is a partly exploded view of a base shown in FIG. 4.

Referring to FIG. 6, the base 210 includes a bottom cover 211 with a cylindrical portion 2111 corresponding to an outline of the main body 220 and a truncated cone portion 2112 protruding downwardly from said cylindrical portion 2111. Said base 210 defines a button 212 positioned on a center of a bottom side of the truncated cone portion 2111. Said base 210 further includes a microphone 213, a PCB (printed circuit board) 215, and a USB (universal serial bus) connector 217, all of which received in the bottom cover 211. Said three LEDs 214 and said USB connector are mounted at the PCB 215. The bottom cover 211 defines a microphone hole 218 corresponding to the microphone 213 and a USB hole 219 receiving the USB connector 217, which provides the speaker 200 of phone function, data transmission function and charging function. The bottom cover 211 also defines a centre hole for placing the button 212 therein and the button 212 functions as turning on/off a power or getting through/hanging up which makes the speaker 200 realize a simple and convenient shift between music and hands-free call. A rubber blanket 216 is stuck onto the bottom surface of the bottom cover 211 to absorb and reduce a vibration of the speaker 200.

The bottom cover 211 forms a centre recession recessed upwardly which the button 212 is positioned in a centre of. And the rubber blanket 216 surrounds and protrudes out of both the centre recession and the button 212. Notably, both the base 210 and the main body 220 are left-right symmetric with respect to the axial section, exteriorly.

Referring to FIGS. 1-6, the speaker 200 can be used either in two with double track for a stereo or in one with monophony. When using the speaker 200 in a single unit, the speaker 200 would automatically build a connection with an exterior device such as telephone, computer, pad or others via Bluetooth once pressing the button 212. When using two speakers 200 in a coordinating way, initially the two speakers 200 would automatically have a Bluetooth connection therebetween once pressing two buttons 212 of them, and then one of them (usually the left channel audio 200*a*) would match up with an exterior device (for example a telephone) via Bluetooth with an automatic distributing process of a left channel audio 200*a* and a right channel audio 200*b* and finally a stereo effect is obtained. When the telephone has an incoming call, the user can press one of two buttons 212 again to switch the functions of the speakers 200, so that the call is extended to the speakers 200 from the telephone. The two independent speakers 200 can be combined in one unit (referring to FIG. 1) and the dimension thereof is configured to be grabbed in one hand, which is convenient for users to carry and helps save storing space. It is noted that the two mating surfaces 230 are unexposed to the exterior when the two speakers 200 (the speaker assembly 100) are secured to each other via a magnetic force, so that the mating surfaces 230, the tweeter 223, the woofer 224, the passive radiator 227, and eta., would be protected from pollution or damage.

Notably, in this embodiment the speaker assembly is of a cylindrical configuration with a circular cross-section. Anyhow, other cross-sections, e.g., the square cross-section, may be provided as long as the mating surface, in a side view, is essentially self-symmetrically arranged with regard to a center point of the mating surface in both the transverse direction and the vertical/axial direction, i.e., being self-diagonal-symmetry with regard to the self-center point, so as to allow the two identical speakers to be assembled in an aligned way along the axial/vertical direction in a mutually opposite manner. From a technical viewpoint, one feature of the invention is to provide an oblique mating/sound emission surface spanning in a direction oblique to the vertical/axial direction, and the tweeter, the woofer and the passive radiator are respectively disposed in such a sound emission surface in order at different levels in the vertical direction and the depths in the transverse direction without interference. Notably, in this embodiment the oblique direction along which the mating/sound emission surface extends is less than 45 degrees relative to the vertical/axial direction of the speaker, and this arrangement is to provide more space for the tweeter, the woofer and the passive radiator independently disposed along the axial/vertical direction in the speaker.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A speaker assembly comprising:

two separate and symmetrical speakers combining together in a reversed manner, each speaker including a base for seating said speaker and a sound emission surface provided at one front side thereof for an emission of sound derived from the speaker; wherein each speaker defines a mating surface which the sound emission surface is located at and said two speakers can be secured to each other snugly into an integral unit by jointing two mating surfaces thereof via a magnetic force, wherein said two speakers combine into a cylinder in shape approximately, each of said speakers is approximately tower-shaped and the mating surface is formed by cutting in and out of a cylindrical surface of said cylinder obliquely, one of said speakers mates to the other one in an upside-down way, the mating surface is S-shaped including a first mating surface curvedly extending backwardly, an up-down oblique second mating surface connecting a bottom side of the first mating surface, and a third mating surface curvedly extending forwardly connecting a bottom side of the second mating surface.

2. The speaker assembly as claimed in claim 1, wherein each speaker includes a main body having a front cover and assembled to the base downwardly, and a plurality of magnets retained in corresponding recessions recessing a rear surface of the front cover, the magnets are evenly distributed along the side edge of the front cover to form a toroidal magnetic field around the mating surface, wherein the magnets respectively disposed in the two speakers present opposite poles to each other for an attraction.

3. The speaker assembly as claimed in claim 2, wherein said front cover defines three circle holes going therethrough to respectively receiving a tweeter, a woofer and a passive radiator in series from up to down.

4. The speaker assembly as claimed in claim 3, wherein said front cover further forms four tubers protruding from the rear surface thereof and extending backwardly out of the rear end of the passive radiator to form a receiving space for receiving a battery latched by the tubers at four corners thereof.

5. The speaker assembly as claimed in claim 2, wherein said speaker includes a net retained onto the front cover backwardly and a rubber ring shrouding the side edge of the net, wherein said mating surface is formed at the front surface of the net, and when two said mating surfaces are mated to each other, two said rubber rings contact to each other.

6. The speaker assembly as claimed in claim 2, wherein said base defines a cylindrical portion corresponding to an outline of the main body and a truncated cone portion protruding downwardly from said cylindrical portion, said base defines a button positioned on a center of a bottom side of the truncated cone portion.

7. A speaker comprising:

a sound emission surface for emitting sound derived from the speaker, wherein said speaker is semi-cylinder having a round bottom surface, a semi-cylindrical surface and a mating surface shrouding the semi-cylindrical surface, so that two said speakers can combine into a complete cylinder in shape when one of them is turned over and mates to the other at two said mating surfaces, wherein the sound emission surface is located at the mating surface, in a side view, said mating surface extends in a self-symmetrical manner with regard to a center point in both a vertical direction and a transverse direction perpendicular to said vertical direction for allowing another identical speaker and said speaker to be aligned and assembled with each other along the vertical direction in a mutually opposite manner with the correspond mating surfaces of said two identical speakers intimately coupled with each other in both said vertical direction and said transverse direction.

8. The speaker as claimed in claim 7, wherein the mating surface is S-shaped including a first mating surface curvedly extending backwardly and an up-down oblique second mating surface extending from the bottom side of the first mating surface and a third mating surface curvedly extending forwardly from the bottom side of the second mating surface.

9. The speaker as claimed in claim 7, wherein said speaker includes a base and a main body with a rear cover and a front cover assembled to the rear cover backwardly, the mating surface are formed on the front cover, said speaker also includes a plurality of magnets retained in corresponding recessions recessing the rear surface of the front cover and the magnets are evenly distributed along the side edge of the front cover to form a toroidal magnetic field around the mating surface.

10. The speaker as claimed in claim 9, wherein said speaker includes a tweeter, a woofer and a passive radiator and said front cover defines three circle holes going therethrough to respectively receiving the tweeter, the woofer and the passive radiator in series from up to down, said front cover further forms four tubers protruding from the rear surface thereof and extending backwardly out of the rear end of the passive radiator to form a receiving space for receiving a battery latched by the tubers at four corners thereof.

11. The speaker as claimed in claim 10, wherein said speaker includes a net retained onto the front cover backwardly and a rubber ring shrouding the side edge of the net and abutting against the inner surface of the rear cover, wherein said mating surface is formed at the front surface of the net, and when two said mating surfaces are mated to each other, two said rubber rings contact to each other.

12. A speaker assembly comprising:

at least one speaker forming a base for seating the speaker in a vertical direction and an oblique sound emission surface on which at least a tweeter and a woofer are exposed; wherein the speaker defines a mating surface which the sound emission surface is located at, in a side view, said mating surface extends in a self-symmetrical manner with regard to a center point in both the vertical direction and a transverse direction perpendicular to said vertical direction for allowing another identical speaker and said speaker to be aligned and assembled with each other along the vertical direction in a mutually opposite manner with the correspond mating surfaces of said two identical speakers intimately coupled with each other in both said vertical direction and said transverse direction.

13. The speaker assembly as claimed in claim 12, wherein said oblique mating surface forms a straight middle region with opposite curved top and bottom regions at two opposite ends in the vertical direction, and said curved top region and said curved bottom region are complementary to each other.

14. The speaker assembly as claimed in claim 12, wherein said base defines a cylindrical cross-section, and said speaker forms a semi-cylindrical surface opposite to said mating surface in said transverse direction so as to form a complete cylindrical configuration when said two identical speaker are assembled together.

15. The speaker assembly as claimed in claim 12, wherein a plurality of magnets are arranged along a periphery of the mating surface for coupling to those of said another identical speaker.

16. The speaker assembly as claimed in claim 12, wherein when assembled, in a top view along the vertical direction, a boundary of said speaker and that of said another identical speaker are also fully overlapped with each other.

17. The speaker assembly as claimed in claim 12, wherein said speaker further includes a passive radiator to cooperate with the tweeter to sandwich the woofer therebetween in the vertical direction so that when assembled, the woofer of the speaker faces the woofer of said another identical speaker in the transverse direction while the tweeter of said speaker faces the passive radiator of said another identical speaker and the passive radiator of said speaker faces the tweeter of said another identical speaker in said transverse direction.

* * * * *